US012416469B2

(12) United States Patent
Kretsinger

(10) Patent No.: US 12,416,469 B2
(45) Date of Patent: Sep. 16, 2025

(54) GATE-KEEPER RIFLE HOLDER

(71) Applicant: TRG Media and Innovations Corp, Burnsville, MN (US)

(72) Inventor: Shane Allan Kretsinger, Grantsburg, WI (US)

(73) Assignee: TRG Media and Innovations Corp, Burnsville, MN (US)

( * ) Notice: Subject to any disclaimer, the term of this patent is extended or adjusted under 35 U.S.C. 154(b) by 268 days.

(21) Appl. No.: 17/993,308

(22) Filed: Nov. 23, 2022

(65) Prior Publication Data

US 2023/0408222 A1 Dec. 21, 2023

Related U.S. Application Data

(60) Provisional application No. 63/353,821, filed on Jun. 20, 2022.

(51) Int. Cl.
*F41C 33/00* (2006.01)
*F41C 23/02* (2006.01)

(52) U.S. Cl.
CPC ..... *F41C 23/02* (2013.01); *F41C 33/006* (2013.01)

(58) Field of Classification Search
CPC ..... F41C 33/00; F41C 33/006; F41C 33/007; F41C 33/008; F16B 21/065; F16B 21/09; Y10T 403/591; Y10T 403/599; Y10T 403/602; A47B 81/005
See application file for complete search history.

(56) References Cited

U.S. PATENT DOCUMENTS 267,714 A * 11/1882 Petmecky ..... F41C 33/006 224/912
2,647,294 A * 8/1953 Davis ..... F16B 12/34 24/639
4,474,492 A * 10/1984 Fleitas ..... B62D 43/04 403/14
5,642,847 A * 7/1997 DeMeo ..... F41C 33/041 224/907
7,128,493 B2 * 10/2006 Alarcon-Lopez ..... F16B 12/22 403/321
2004/0037636 A1 * 2/2004 Babcock ..... F16B 21/09 403/353
2005/0078010 A1 * 4/2005 Christoph ..... F16B 21/09 340/693.5
2005/0204764 A1 * 9/2005 Lomp ..... B60H 1/00535 62/239

(Continued)

*Primary Examiner* — Gabriel J. Klein
(74) *Attorney, Agent, or Firm* — Westman, Champlin & Koehler, P.A.

(57) ABSTRACT

A firearm attachment and method for transport implementing a receiver plate affixed permanently, semi-permanently, or removably to tactical, or non-tactical clothing items or accessories. The receiver plate has one or more apertures with means of latching, clasping, or otherwise grasping by way of a fork, pin, keyhole, or other geometry that may cause an interference fit with an insertion pin, post, or other appendage. The insertion post may be a modified or repurposed take-down pin that is a modification or improvement of a component already existing on a firearm. A insertion post may also be affixed to an accessory aperture or other device, existing on or mounted on a firearm or on accessories mounted to the firearm.

12 Claims, 10 Drawing Sheets

(56) References Cited

U.S. PATENT DOCUMENTS

| | | | | |
|---|---|---|---|---|
| 2005/0226684 | A1* | 10/2005 | Lopez | F16B 12/22<br>403/231 |
| 2013/0276343 | A1* | 10/2013 | Peters | F41C 33/007<br>29/469 |
| 2014/0086675 | A1* | 3/2014 | Busch | F41C 33/007<br>403/322.2 |
| 2014/0190054 | A1* | 7/2014 | Ascano | F41C 33/005<br>42/71.01 |
| 2015/0233669 | A1* | 8/2015 | Ponder | F41C 33/001<br>224/271 |

* cited by examiner

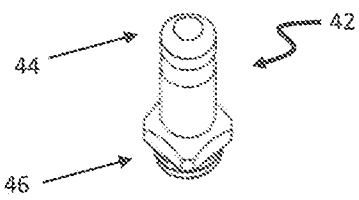
FIG. 12B
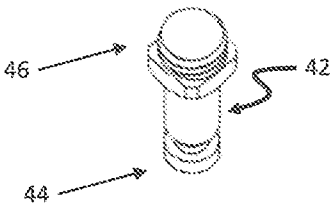
FIG. 12A
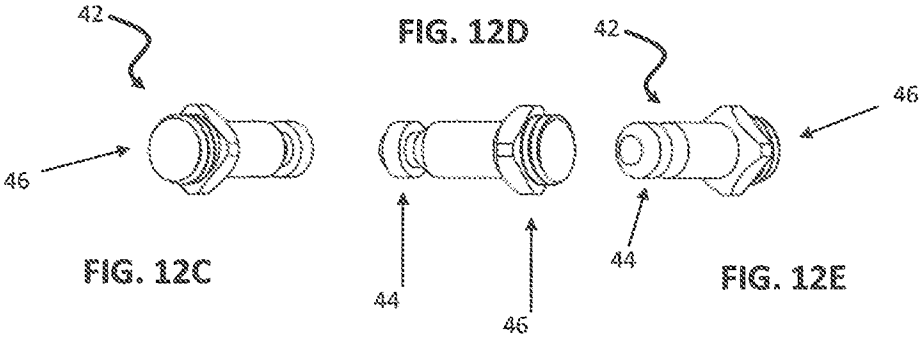
FIG. 12E
FIG. 12D
FIG. 12C

GATE-KEEPER RIFLE HOLDER

CROSS-REFERENCE TO RELATED APPLICATION

This application claims priority to and the benefit of U.S. provisional patent application Ser. No. 63/353,821, filed 20 Jun. 2022, the contents of which are incorporated herein in their entirety.

BACKGROUND

Strap type slings for Rifles and Long guns have been beneficial since the first long gun was introduced in the 13$^{th}$ century. The sling aids the arms carrier in transporting the rifle and/or long gun over different types of terrain and in various environments.

More recently, with the introduction of modern battle rifles and sporting guns of all shapes, sizes and designs, a wider variety of modern gun slings have been developed to make the carrying or transporting long guns for extended periods of time such as might occur on hunting expeditions, military patrolling operations, and even stationary guard duty scenarios, more comfortable for the user.

Slings are typically separated into the classifications of single point (of attachment) or two-point (of attachment) slings.

These slings generally attach to an attachment point on the fore end, a mid point attachment, and/or the butt end of a long gun and allow the gun to be carried and supported by a strap either over the user's shoulder, or routed around the user's neck.

With wider use of specialized equipment vests and plate carriers, (which are a ballistics vest/equipment vest hybrids) by law enforcement, military, and civilians, new methods of supporting long guns are needed.

The M16 rifle, invented in in the late 1950's, and the many variations or derivatives that have been developed since, have all historically utilized the same strap sling carrying methodology.

Due to the Military Specifications on standardization, (mil-spec standardization) of rifles that follow the original M16 platform, and other firearms platforms that have adapted similar standardization within their business model, designing support systems for specific families of firearms is necessary.

SUMMARY

One aspect of the present disclosure relates to a mounting device comprising a housing having two housing apertures; and a capture interface having two spaced apart latching apertures aligned with the two housing apertures and wherein the capture interface is moveable within the housing and the latching apertures are configured to receive and couple to one or more insertion posts to secure a first end of the insertion posts to the mounting device.

The capture interface is a spring biased receiver plate wherein the capture interface is moveable between a first position and a second position wherein in the first position a first portion of the latching apertures are exposed and configured to receive the first end of the insertion post therein and wherein in the second position a second portion of the latching apertures are exposed and configured to hold the end of the insertion post therein.

The insertion posts are extensions, modifications, or specialized versions of takedown pins for a firearm.

A second end of the insertion posts are appendages attached to a firearm, a mounted firearm accessory, or firearm assembly components which have been modified to serve a purpose on the firearm, and as a means of attaching the firearm to the receiver plate.

The takedown pins comprise an o-ring, retaining ring, retaining pin, or bushing for aiding attachment of the pin to an object or accessory such as a firearm.

The housing is configured for fixedly or removably attaching to clothing, accessories, or backpacks.

The insertion posts are fixedly or removably attached to available accessory mounting geometry on a firearm or an attachable firearm accessory.

The housing comprises one or more funneled features surrounding each housing aperture for guiding each insertion post into the corresponding latching aperture on the capture interface.

The insertion posts are slotted for use with a fork type locking mechanism.

The insertion posts comprise holes for retention by pins inserted either manually or mechanically there through.

The receiver plate is comprised of metal, alloy, composite plastic, carbon fiber, or combinations thereof.

The latching apertures comprise one or more latching features that mate with insertion pins, posts, or appendages.

A lever on the housing is a release lever that is moveable to move the capture device between the first and second positions.

Yet another aspect of the present disclosure relates to a receiver mount comprising a receiver plate body; and one or more connection mechanisms on the plate body and configured to receive an insertion pin or an adapter pin for supporting a device on the receiver plate body, wherein the one or more connection mechanisms each comprises a receiver hitch latching aperture for receiving and removably coupling to a corresponding end of the insertion post or adapter pin.

An adapter plate having a plurality of apertures spaced apart thereon is configured to couple to an opposing end of the adapter pin such that one or more adapter pins secure the adapter plate to the receiver plate body which is then also securing to the device for coupling the device to the receiver mount.

The device is a firearm or firearm accessory.

The insertion post is a first insertion post and further comprising a second insertion post wherein first ends of the first and second insertion posts are each coupled to the receiver hitch latching aperture of a corresponding connection mechanism and second ends of the first and second insertion posts are each coupled to the device, a firearm, a mounted firearm accessory, or firearm assembly component.

The one or more connection mechanisms comprises tapered or funneled surfaces surrounding an aperture in the receiver plate body which is aligned with the receiver hitch latching aperture and exposes the receiver hitch latching aperture and wherein the receiving hitch latching aperture is moveable in reciprocal direction while the receiver mount aperture remains stationary.

Yet another aspect of the present disclosure relates to a method for mounting a device onto a receiver mount comprising coupling a receiver plate body to clothing or equipment; moving a receiver plate within the receiver plate body to a first position; inserting a terminal end of one or more insertion posts secured to the device into one or more corresponding latching apertures in the receiver plate body; releasing a latch on the receiver plate body to move the receiver plate to a second position for latching the one or more insertion posts therein; and retaining the device on the receiver mount.

The device is a firearm and the one or more insertion posts comprise takedown pins mounted on or otherwise secured to the firearm and protruding from the firearm.

The takedown pins comprise factory original takedown pins for the firearm, modified takedown pins installed on the firearm, or combinations thereof.

Yet another aspect of the present disclosure relates to an insertion post comprising a shaft terminating in a head and a midpoint radial slot, a capture geometry, and an extended length, wherein the capture geometry comprises an o-ring, retaining ring, retaining pin, or bushing configured to allow the extended length to couple to a takedown pin aperture on a firearm and prevent the shaft from being driven into the aperture on the firearm.

The insertion post is a take-down pin and is configured to couple to one or both of a receiver mount for a firearm or an adapter plate for the receiver mount for the firearm. The extended length of the insertion post is at least approximately ¾ inches.

BRIEF DESCRIPTION OF THE DRAWINGS

FIGS. 12A to 12E are various views of adapter pins for use with an adapter plate as illustrated in FIGS. 13A and 13B.

DETAILED DESCRIPTION

Figure 2:
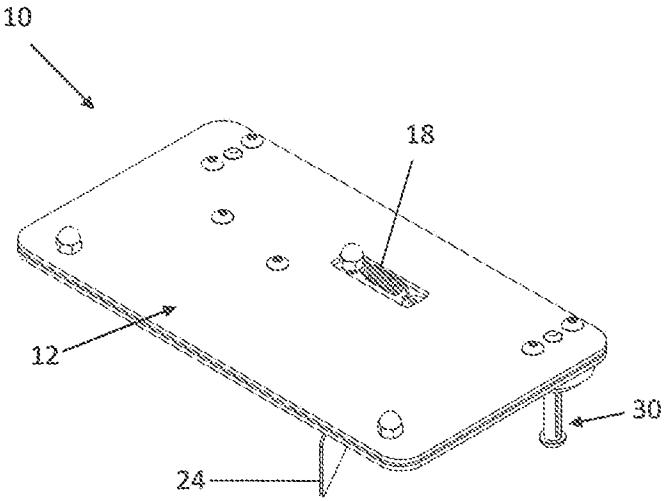
FIG. 2 is a rear view thereof.

Described herein are attachment devices and methods for transport of accessories wherein the devices and methods implement a receiver plate that can be affixed permanently, semi-permanently, or removably to tactical, or non-tactical clothing items, equipment, or accessories such as backpacks, utility belts, or various other items. While examples discussed throughout this disclosure relate to a device for supporting a firearm thereon, a firearm is merely one non-limiting example, and various other objects and/or accessories may be secured to the receiver plate directly as discussed throughout this disclosure and/or by way of an adapter plate.

The device according to one or more embodiments described herein includes a housing which supports a receiver plate. The receiver plate is moveable, for example, slidable within the housing and the receiver plate is further configured with one or more apertures which receive one or more insertion posts. The receiver plate may also be referred to herein as a capture device or movable capture device. The one or more apertures are spaced apart on a face of the receiver plate. These apertures may be referred to as receiver hitch latching apertures, latching apertures, key hole apertures or the like. The distance between these apertures may correspond to the placement of take-down pins on a specific firearm. Movement of the receiver plate affects locking and unlocking of the insertion posts to the receiver plate, thus securing the insertion posts to the housing. The insertion posts are also concurrently secured to an object or accessory, for example, a firearm.

The insertion posts are configured on a first, terminal end for insertion into a corresponding aperture on the receiver plate and secure thereto by way of latching, clasping, or otherwise grasping by way of a fork, pin, keyhole, or other geometry that results in interference fit between the receiver plate and the insertion post(s).

The housing is provided with apertures that are aligned with the receiver plate apertures as the plate is moveable within its position in the housing. The housing then may be provided one or more guide mechanisms on an external surface of the housing. These guide mechanisms may guide a corresponding one of one or more insertion posts into the corresponding aperture in the receiver plate positioned there below. The insertion post is then guided into connection with an aperture where the receiver plate is in a first position, an "unlocked position." The receiver plate is then moved to a second position, a locked position, which captures a surface of the insertion pin in the aperture of the receiver plate, thus securely holding the insertion pin therein.

When in the locked position, the posts are received in the corresponding aperture of the receiver plate and are latched, clasped or otherwise grasped by the receiver plate in a manner where movement in and out of the aperture is prevented. Correspondingly, the receiver plate is in an unlocked positioned when the one or more insertion posts are free to move in and out of the corresponding aperture in the receiver plate.

The receiver plate may be manually moved or slid to one position, for example, the unlocked position. The receiver plate may be held in this unlocked position by way of a locking mechanism which engages with a surface of the housing to retain the receiver plate in the unlocked position. A spring may then be provided operably coupled to and biasing the receiver plate to return the receiver plate automatically to the second position, the locked position. Disengaging the locking mechanism from the surface of the housing then allows the spring to relax which forces the receiver plate to the locked position.

For example, the locking mechanism comprises a flange, post, plate or other mechanism configured to manually moved with only one digit, for example, the thumb. The flange, post, plate or other mechanism is moveable in reciprocal directions within a corresponding slot or channel. The locking mechanism may be movable in one or more directions. For example, the locking mechanism may move with the receiver plate as an extension of the receiver plate. The locking mechanism may additionally move in an additional direction allowing the locking mechanism to move with the receiver plate as an extension of the receiver plate as well as move towards or away from the surface of housing for engaging and disengaging with the surface of the housing.

It is also contemplated and within the scope of the disclosure that the spring biasing the receiver plate may be positioned in a manner to automatically move the receiver plate to the unlocked position if desired, and require manual force to move the receiver plate to the locked position.

The device described herein provides a means of supporting a device, such as a long gun in conjunction with the equipment vests, ballistic vests, backpacks, and similar wearable items of clothing or accessories. The one or more insertion post(s) may be directly mounted to the firearm by threaded means, or attached with the use of adapter plates, rings, locking cams, and/or combinations thereof to fix the insertion post(s) directly to the firearm or other accessories. The insertion post(s) may also be a component of the firearm itself or a modified version of a firearm component such as a "takedown pin" that is already found within the design of the firearm. The insertion posts may be used in place of standard takedown pins and thus function on the firearm as takedown pins and also act as insertion posts for coupling to the receiver plate and thus mounting the firearm thereto.

A first end of the one or more insertion posts is configured for removably securing to the apertures in the receiver plate such that the one or more posts are removably coupleable to the housing. A second opposing end of the one or more insertion posts is then configured for or otherwise secured to an accessory for securing to the housing. The accessory may be one of various model firearms. In such embodiments, the insertion post(s) comprise take-down pins original to the firearm or extended, modified or re-purposed take-down pins of a firearm. These insertion posts that comprise modified takedown pins may be longer than a standard takedown pin along the shaft of the pin. In one embodiment, the insertion posts may be modified extended take-down pins having a length approximately ¾ inches longer than a factory or standard take-down pin. The insertion posts and/or modified posts may further comprise a capture geometry such as an o-ring, retaining ring, retaining pin, bushing, or the like thereon. The capture geometry is positioned on a length of the post (e.g., pin) and may be positioned at a midpoint radial slot. The capture geometry is provided on post and may be connected to the midpoint radial slot of the post and may be provided for the purposes of preventing the post from being driven out of (into) the firearm while the insertion post is also being connected to the device described herein. This capture geometry of the modified insertion post may act as a lock for locking the position of the insertion post on the firearm. Additionally, or alternatively, the insertion posts may be slotted for use with a fork type locking mechanism. The insertion posts may also include holes for retention by pins or similar methods inserted either manually or mechanically therein. Further, the insertion posts may have one or more threaded ends for coupling to internally threaded openings in a firearm or other accessory.

As discussed herein, takedown pins may be the mechanism used to attach the accessory, such as a firearm, to the assembly. In some embodiments the use of takedown pins for insertion pins is dependent upon what type of firearm is used. For example, factory takedown pins may be replaced with the modified takedown pins, which protrude outside of the body of the firearm, giving the pins enough length to feature the geometry necessary to be grasped by the connection guide of the assembly.

In additional or alternative embodiments, an adapter plate may be provided for coupling to the device. The adapter plate couples to the receiver plate via one or more adapter pins. The adapter plate has a plurality of adapter apertures spaced there along. One or more adapter pins can then be coupled to one or more adapter apertures that align spacing wise with the guide mechanism spacing and thus the apertures in the receiver plate. This allows the adapter plate to lock into connection with the device. Additional apertures in the adapter plate are then usable with pins, fasteners or the like for coupling to an object or accessory for removably mounting the same on the housing. The adapter plate thus can couple to both the housing and an additional object or device, regardless of whether that additional object or device is a firearm or other accessory.

Attachment of the device to wearable clothing items or accessories, either by permanent or removable methods, allows for the direct attachment of firearms such as rifles or other long guns by utilizing attachment equipment designed to fit the common features of the pre-existing firearm. This device effectively bridges the gap between slings commonly used with long guns and holsters which are commonly used with handguns.

The device housing may further be provided with a mounting geometry on a rear or back side of the housing which is configured to mate with a mounting device which can engage with MOLLE PALS strapping or otherwise have a rear surface capable of mounting the user's clothing or equipment.

Figure 1:
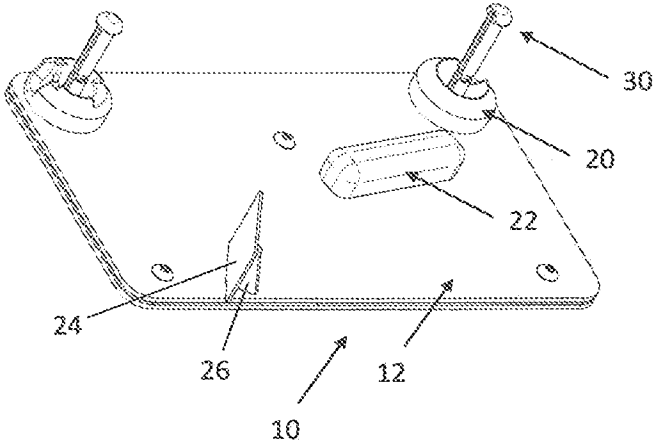
FIG. 1 is a front perspective view of a holder assembly according to one or more embodiments described herein.
Figure 4:
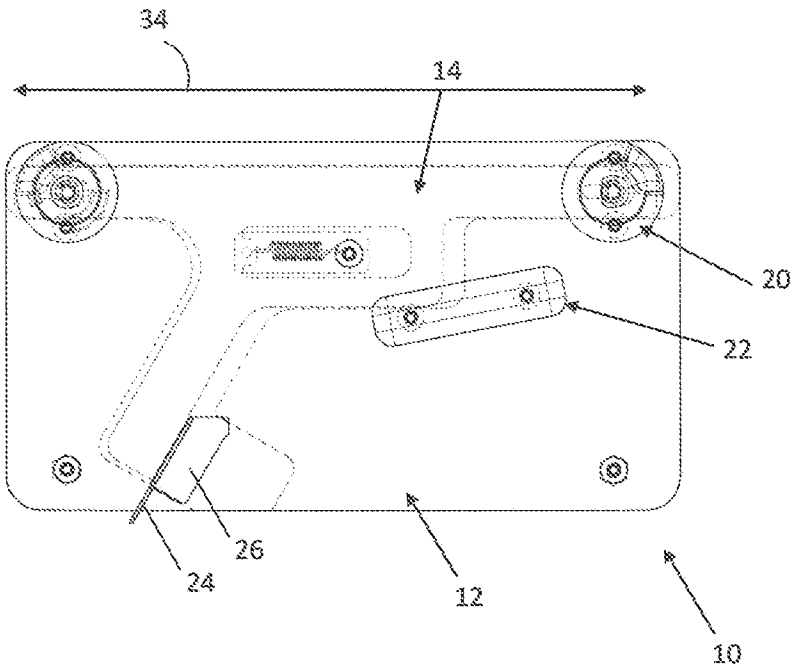
FIG. 4 is a front view showing the firearm holder assembly and receiver plate as mounted therein.
Figure 3A:
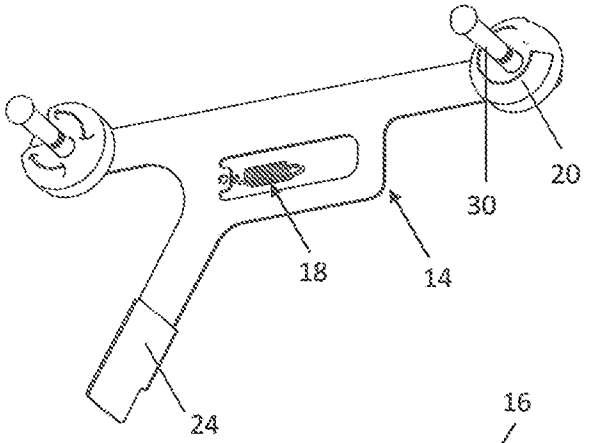
FIGS. 3A and 3B are front and rear views of a receiver plate of the holder assembly.
Figure 3B:
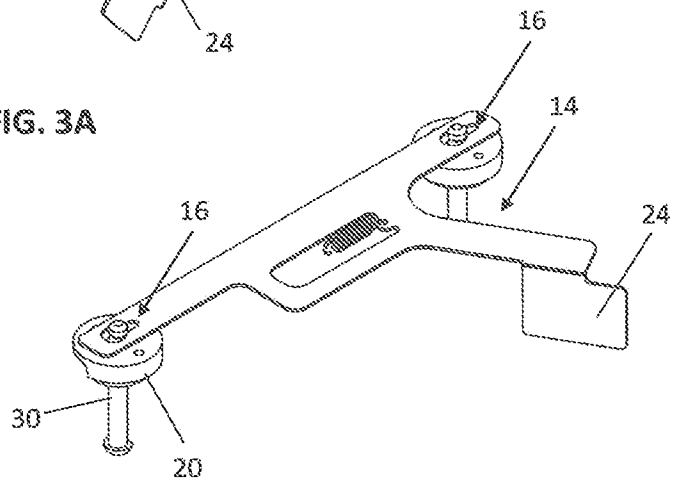
Figure 5:
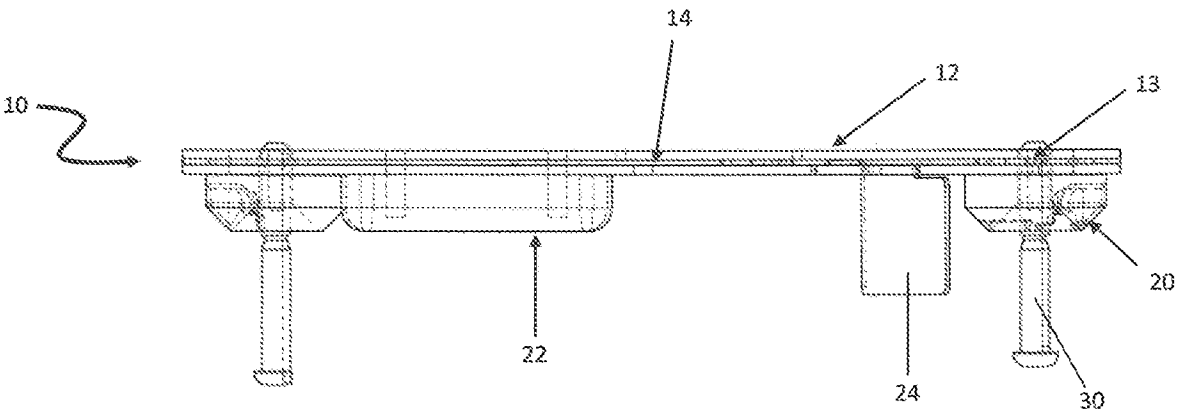
FIG. 5 is a side view of the device illustrated in FIG. 4.

In one embodiment as illustrated in FIGS. 1-5, a device 10 comprises a housing 12 and a receiver plate 14 movable therein. The housing 12 has a first surface for supporting a firearm and a rear surface which may then abut a user or otherwise contact or couple to the users clothing or an accessory for mounting the device 10 thereto. In use, the device 10 is secured to a user article or accessory by way of a fixed or a removable attachment to clothing, accessories, backpacks or the like. The device 10 may be removably secured to the user's clothing, accessory or equipment by way of clips, fasteners, straps or combinations thereof.

In further detail, the housing 12 supports one or more connection guides 20 which are configured to guide insertion posts 30 or adapter pins 42 into a corresponding latching aperture 16 of the receiver plate 14. The housing 12 is provided with apertures 13 that are aligned with the latching apertures 16 of the receiver plate 14. The latching apertures 16 may be keyholes or other notched openings for securing the insertion posts 30 to the housing 12. The receiver plate 14 is slidable to secure the insertion post 30 to the housing 12 as discussed in further detail below.

The device 10 may further comprise one or more surfaces 22 for steadying and/or maintaining the firearm in position on the device 10.

The connection guides 20 may have one or more funneled features to guide the insertion of each insertion post 30 or adapter pin 42 into the latching aperture 16 of the receiver plate 14. The latching apertures 16 are spaced apart on a surface of the receiver plate 14 and in this embodiment comprise notched slots 16 positioned below each connection guide 20. The notched slot 16 has a first end, the notch, with a larger opening than provided by the adjoining slot. The connection guide 20 guides a protruding, terminal end of the insertion post 30 or adapter pin 42 into the notch. As the receiver plate 14 is moved in a first direction, the slot is moved to the insertion post 30 to capture and lock the terminal end of the insertion post 30 therein. The receiver plate 14 is slidable in reciprocal directions as shown by arrows 34 such that unlocking the insertion posts comprises moving the receiver plate 14 in the opposite direction to move the notch of the latching aperture 16 to the terminal end of the insertion post 30 so that the insertion post 30 can be removed or disengaged.

The receiver plate 14 is spring biased with a return spring 18 which is secured to the housing 12 on one end in a fixed manner. The spring 18 is also operably coupled to and/or operably in contact with the receiver plate 14, for example on a second end of the spring 18 to bias or otherwise move the receiver plate 14. The receiver plate 14 is then manually moveable to a first position which may be an unlocked position by way of pushing a locking plate 24 along a slot 26 in the housing 12. When manual force is removed from the locking plate 24, the spring relaxes and forces automatic return of the receiver plate 14 to a locked position. The locking plate 24 may be a tab or other surface integral to and extending from the receiver plate 14.

Figure 6B:
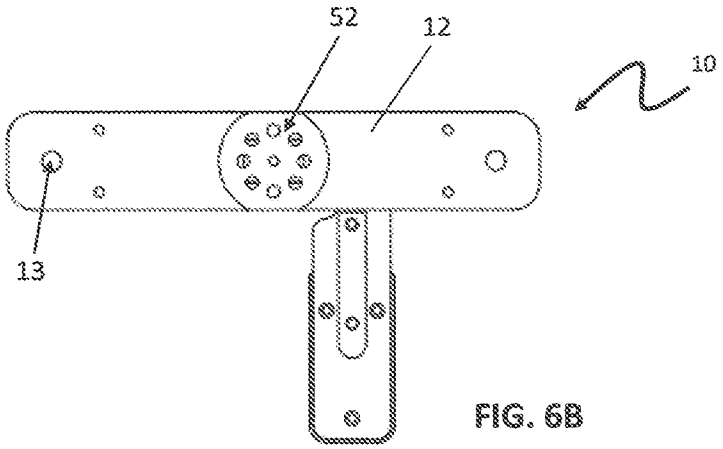
FIGS. 6A and 6B illustrate front and rear views of another embodiment of the holder assembly.
Figure 6A:
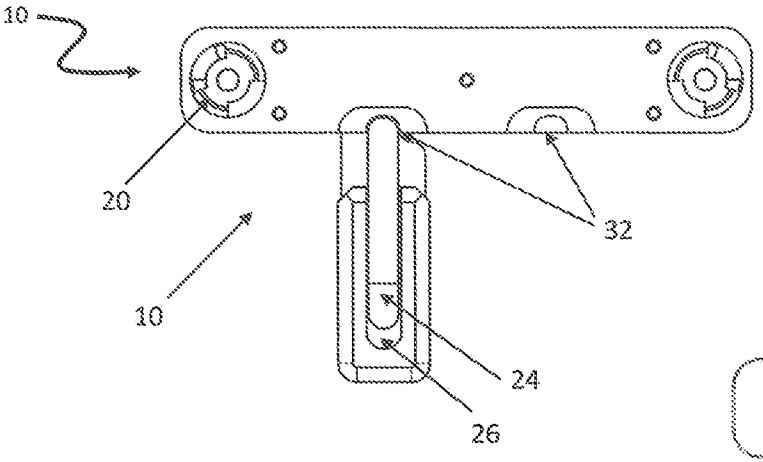
Figure 7B:
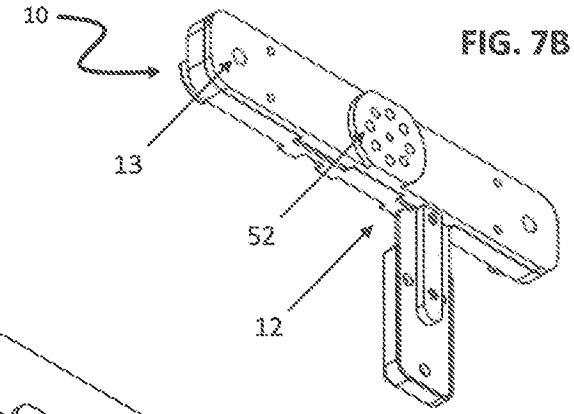
FIGS. 7A and 7B illustrate front and rear perspective views of the holder assembly according of FIGS. 6A and 6B.
Figure 7A:
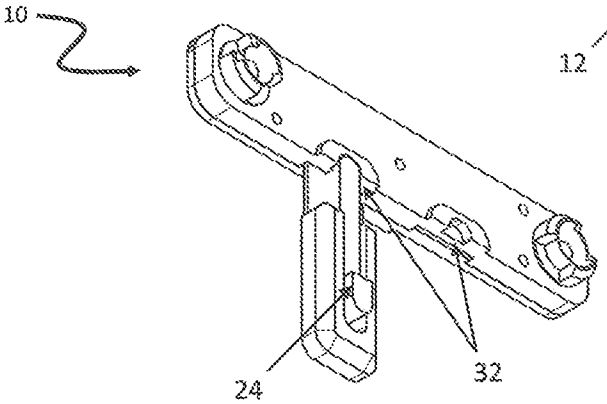
Figure 8:
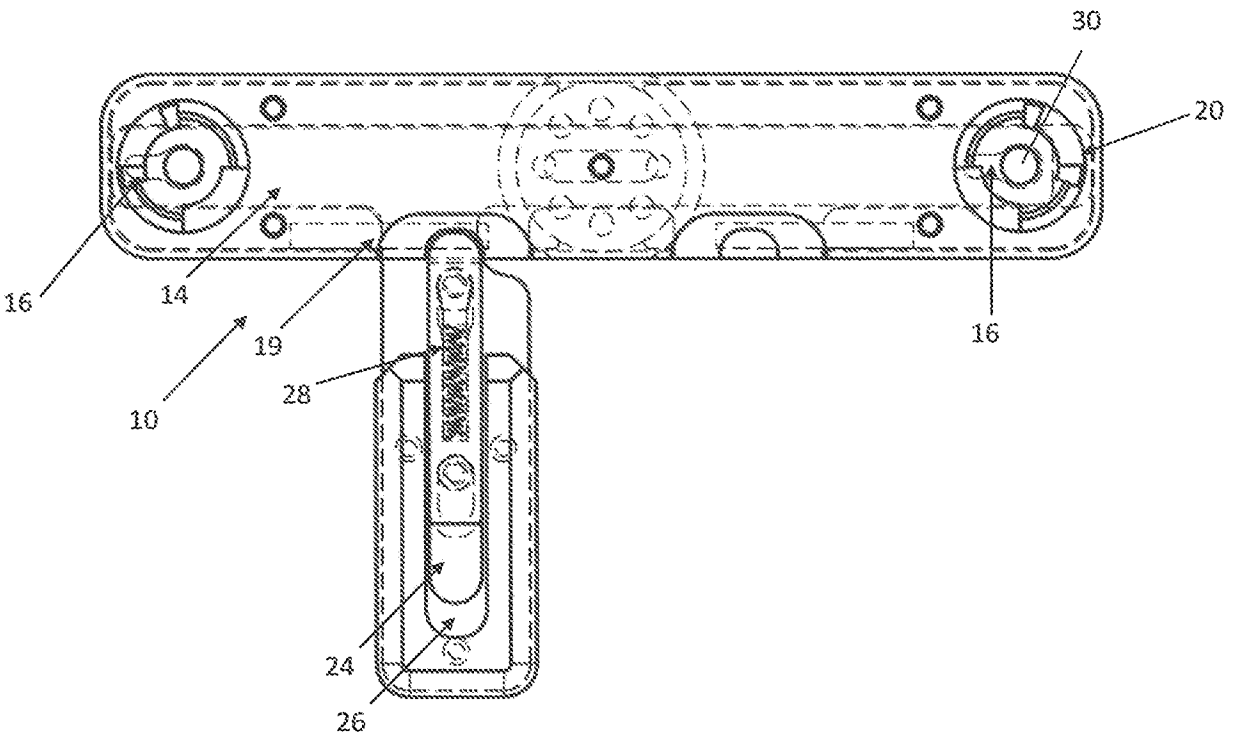
FIG. 8 is a front view of a assembly showing internal components of the holder assembly.

In an additional or alternative embodiment illustrated in FIGS. 6A-8, the device 10 has a housing 12 with the receiver plate 14 therein. The receiver plate comprises keyhole latching apertures 16 for coupling to insertion posts 30. The receiver plate 14 is again spring 18 biased wherein the spring 18 resides in a channel 19 inside the housing 12. The spring 18 biases movement of the receiver plate 14 and thus can be used to automatically return the receiver plate 14 to a locking position. It is possible to move the spring 18 to the opposite side of the receiver plate 14 by moving the spring 18 in the channel 19 and thus offering a selectively ambidextrous device by flipping the receiver plate 14 over or allowing for automatic return of the receiver plate 14 to the unlocked position instead of the locked position. The housing 12 and receiver plate 14 have corresponding openings to allow for movement of the components, including slot 26.

The locking mechanism 24 is reciprocally displaced along the slot 26. When the locking mechanism 24 is used, a first end of the locking mechanism 24 engages with a locking surface 32 on the housing 12. A second spring 28 is provided to bias the locking mechanism in addition to the spring 18 which biases the receiver plate 14. The spring 18 and second spring 28 are positioned in the housing in perpendicular orientations for effecting different directional movement. The second spring 28 forces the locking mechanism 24 towards and into the locking surface 32 on the housing. At the same time, spring 18 is compressed. Thus, the receiver plate 14 is locked in one position, for example, the open position for the insertion or removal of the insertion posts 30. Manual force is then required then to disengage the locking mechanism 24 from the locking surface 32 and compress second spring 28 while spring 18 is released which moves the receiver plate 14 accordingly and concurrently, such that the receiver plate 14 is automatically held in another position, for example, the locked position. The second spring 28 is compressed and the end of the locking mechanism rests on a surface of the housing 12.

A second notch 32 may be provided for an alternative orientation of the device 10, for example, switching the device between a "right handed" device and a "left-handed" device.

Figure 10:
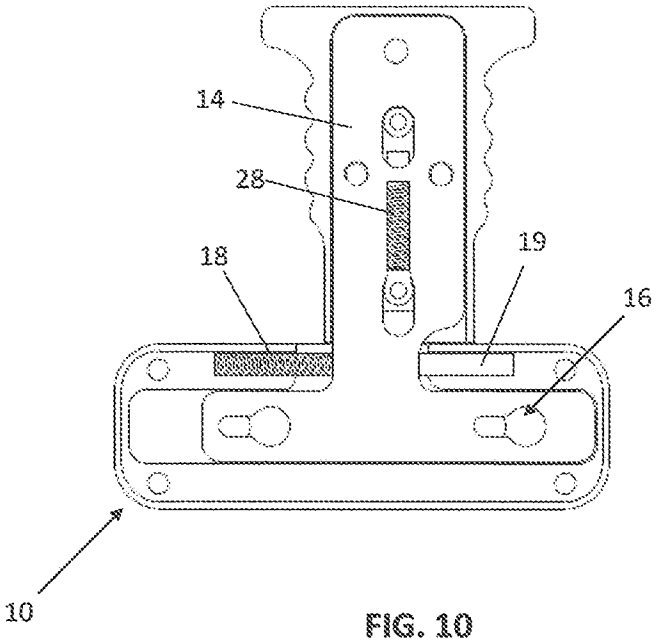
FIG. 10 is a front view of the embodiment in FIG. 9 with a front portion of a housing thereof removed to show interior components of the assembly.
Figure 9:
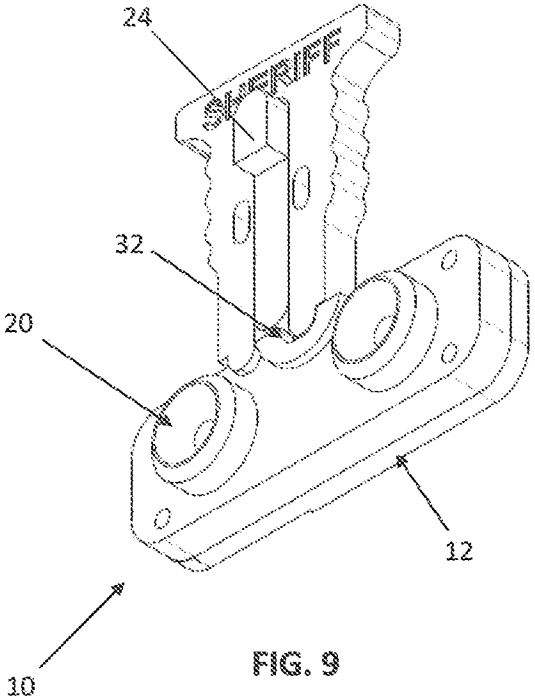
FIG. 9 is a front view of another embodiment of the holder assembly.
Figure 11B:
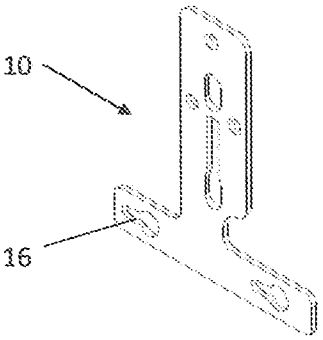
FIGS. 11A and 11B are front and side perspective views of an embodiment of a receiver plate for the assembly holder.
Figure 11A:
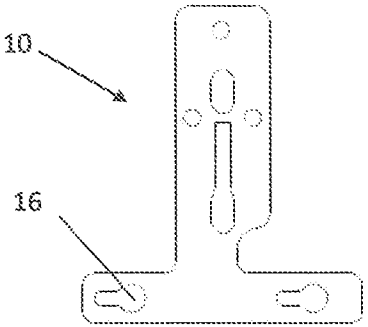

The device 10 may further be provided in smaller dimensions as illustrated in FIGS. 9 to 11B, such that spacing between latching apertures 16 is reduced and only one locking surface 32 is provided on the housing 12. It is also contemplated and within the scope of this disclosure that the spacing between the latching apertures may be further increased with respect to the embodiment illustrated.

The device 10 according to one or more embodiments herein may further be provided with mounting geometry 52 on a rear face of the housing 12. This mounting geometry 52 may be used to couple the device 10 to a mounting device which easily couples to a user's gear or clothing for example. The mounting geometry 52 may comprise a series of apertures and protrusions in selected patterns which couple with reciprocal mounting geometry on clips of other hardware for use.

Figure 13B:
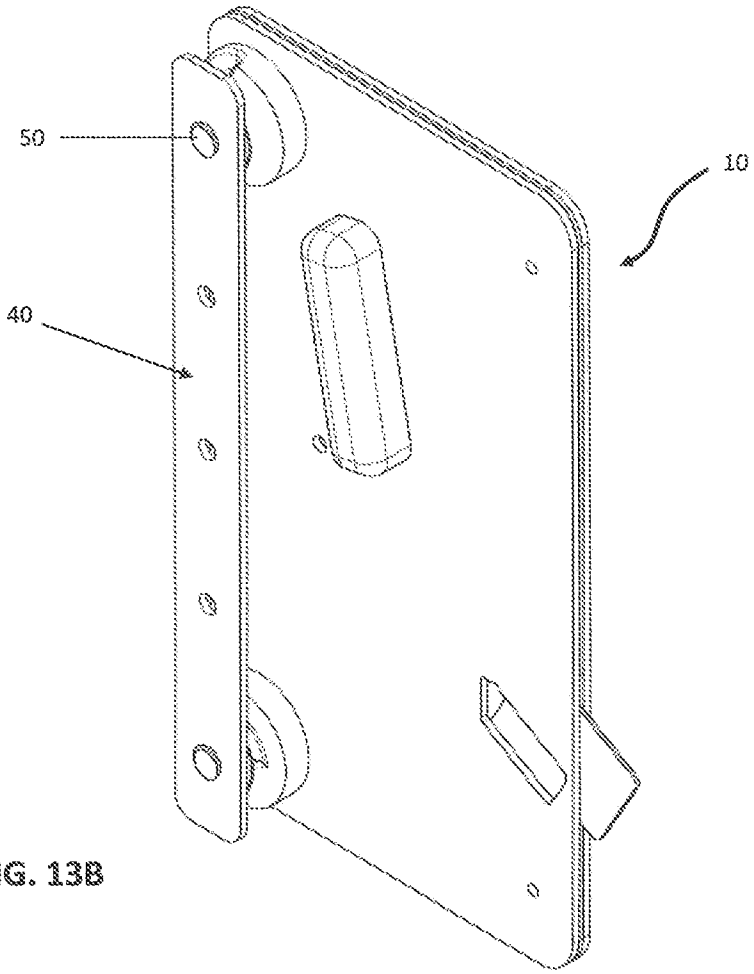
FIG. 13B is a front perspective view of the adapter plate mounted to a holder assembly.
Figure 13A:
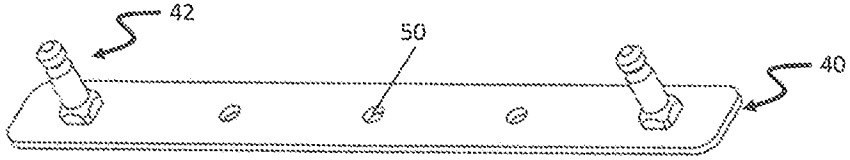
FIG. 13A is a perspective view of an adapter plate for a holder assembly according to any one or more embodiments described herein.

One or more embodiments of the device 10 described herein may be used with an adapter plate 40 as illustrated in FIGS. 12A-13B. The adapter plate 40 and adapter pins 42 are illustrated with respect to one non-limiting device 10 configuration. The adapter plate 40 has a length that comprises one or more apertures 50 spaced therealong. The apertures 50 are configured for receiving one or more adapter plate pins 42. These apertures 50 may also be mounting holes for securely coupling to adapter pins 42. Additional apertures may then be used with additional fasteners, pins, posts, clips or other mechanisms to couple the adapter plate 40 to an object or accessory which may or may not be a firearm or accessory. Thus, the adapter plate 40 is secured to the device 10 and a second object, device or accessory. The adapter pins 42 also comprise a terminal end 44 which is configured in the manner of an insertion post 30 as described above having a neck or lip which is configured to latch to the slot of the latching aperture 16 of the receiver plate 14 of any one or more of the embodiments of devices 10 described above. A proximal end 46 of the adapter pin 42 is securable in one of the apertures 50 of the adapter plate 40.

The coupling of the adapter pins 42 to the receiver plate 14 may be a friction fit, snap fit, releasable fit, or other removably mechanical coupling of surfaces.

As mentioned previously, the insertion posts 30 are coupled to the firearm at a proximal end of the insertion pin while the terminal end of the insertion pins 30 is insertable into the connection guide 20.

The device 10 may comprise a housing 12 and/or receiver plate 14 according to one or more embodiments herein and which may be made of metal such as steel, titanium or like metals, alloys, composite plastics, carbon fiber or combinations thereof. The insertion posts 30 may be made of metals, alloys, composite plastics, carbon fiber, or combinations thereof. The device, its components and the insertion posts may be constructed from the same or different materials or combinations. Similarly, the adapter plate and/or adapter plate pins may be made of metals, alloys, composite plastics, carbon fibers, or combinations thereof.

Although the present disclosure has been described with reference to preferred embodiments, workers skilled in the art will recognize that changes may be made in form and detail without departing from the spirit and scope of the disclosure.

The invention claimed is:

1. A mounting device for a firearm, the mounting device comprising;

a housing having two housing apertures;

at least two insertion posts; and a capture interface having two spaced apart latching apertures aligned with the two housing apertures and wherein the capture interface is moveable within the housing and the each latching aperture is configured to receive and couple to one of the insertion posts to secure a first end of each insertion post to the mounting device, wherein the housing comprises one or more funneled features extending outwardly therefrom and surrounding each housing aperture for receiving and guiding each insertion post into the corresponding latching aperture on the capture interface, and wherein the insertion posts comprise extended takedown pins for the firearm or are pins of an adapter mounted to the firearm such that the mounting device is configured to support a firearm thereon.

2. The mounting device of claim 1 wherein the capture interface is a spring biased receiver plate wherein the capture interface is moveable between a first position and a second position wherein in the first position first portions of the latching apertures are exposed and configured to receive the first ends of the insertion posts therein and wherein in the second position second portions of the latching apertures are exposed and configured to hold the first ends of the insertion posts therein.

3. The device of claim 2, and further comprising a lever on the housing which is a release lever that is moveable to move the capture interface between the first and second positions.

4. The mounting device of claim 1, wherein the insertion posts are extensions, modifications, or specialized versions of takedown pins for a firearm.

5. The mounting device of claim 4, wherein the takedown pins comprise an o-ring, retaining ring, retaining pin, or bushing.

6. The mounting device of claim 1, wherein second ends of the insertion posts are appendages attached to a firearm, a mounted firearm accessory, or firearm assembly components which have been modified to serve a purpose on the firearm, and as a means of attaching the firearm to the receiver plate.

7. The mounting device of claim 1, wherein the housing is configured for fixedly or removably attaching to clothing, accessories, or backpacks.

8. The device of claim 1, wherein the insertion posts are fixedly or removably attached to available accessory mounting geometry on a firearm or an attachable firearm accessory.

9. The mounting device of claim 1, where the insertion posts are slotted for use with a fork type locking mechanism.

10. The mounting device of claim 1, where the insertion posts comprise holes for retention by pins inserted either manually or mechanically there through.

11. The mounting device of claim 1, wherein the receiver plate is comprised of metal, alloy, composite plastic, carbon fiber, or combinations thereof.

12. The mounting device of claim 1, wherein the latching apertures comprise one or more latching features that mate with insertion pins, posts, or appendages.

* * * * *